US010800018B2

(12) United States Patent
Yen

(10) Patent No.: US 10,800,018 B2
(45) Date of Patent: Oct. 13, 2020

(54) CRIMPING TOOL

(71) Applicant: Kauw Yehi Industrial Co., Ltd., New Taipei (TW)

(72) Inventor: Yu-Ting Yen, New Taipei (TW)

(73) Assignee: KAUW YEHI INDUSTRIAL CO., LTD., New Taipei (TW)

( * ) Notice: Subject to any disclaimer, the term of this patent is extended or adjusted under 35 U.S.C. 154(b) by 290 days.

(21) Appl. No.: 15/945,113

(22) Filed: Apr. 4, 2018

(65) Prior Publication Data

US 2019/0308304 A1 Oct. 10, 2019

(51) Int. Cl.
*B25B 27/14* (2006.01)

(52) U.S. Cl.
CPC ..... *B25B 27/146* (2013.01)

(58) Field of Classification Search
CPC ..... B25B 7/12; B25B 27/10; B25B 27/146; H01R 43/042; H01R 43/0425; H01R 43/04
See application file for complete search history.

(56) References Cited

U.S. PATENT DOCUMENTS 6,708,369 B1 * 3/2004 Liao ..... E05D 5/0246 16/239
7,120,997 B2 * 10/2006 Islam ..... B25B 27/10 29/751
2009/0011638 A1 * 1/2009 Wang ..... H01R 9/05 439/585
2015/0372436 A1 * 12/2015 Chou ..... H01R 43/042 29/753
2018/0015599 A1 * 1/2018 Chen ..... B25B 5/127

* cited by examiner

*Primary Examiner* — Debra M Sullivan
(74) *Attorney, Agent, or Firm* — Chun-Ming Shih; HDLS IPR Services

(57) ABSTRACT

A crimping tool includes a base, a press handle, a slide module, a link and a fixed fix shaft. The base has two first side walls and to sliding space is defined therebetween. One end of the press handle is pivoted at an end of the base. The slide module is slidably accommodated in the sliding space and has a guiding groove. Two ends of the link are pivoted at the press handle and the slide module separately. The fix shaft is disposed across the two first side walls and inserted in the guiding groove. When the press handle drives the slide module sliding in the sliding space through the link, the guiding groove of the slide module will be guided and restricted by the fix shaft. Therefore, the guiding grooves will not be damaged and get dirt.

13 Claims, 13 Drawing Sheets

CRIMPING TOOL

BACKGROUND OF THE INVENTION

Field of the Invention

The present invention generally relates to a hand tool and, more particular to, a crimping tool.

Description of Prior Art

Concerning crimping tools, operations of crimping and cutting are performed through a link driving a slider moving in the seat by users pressing a handle, such as a crimping tool is used for crimping of cables and connectors or a cutting hand tool is used for cutting off surplus cables.

For a conventional crimp tool, an upper end of the link is pivoted on the handle, and a lower end is pivoted on the slider through a shaft so that two ends of the shaft are disposed across two walls of the seat, wherein each of the two walls has disposed a guiding groove, and the two ends of the shaft can be moved back and forth between a front end and a rear end of the guiding groove for driving the slider moving back and forth in the seat.

However, the connections of the conventional crimping tool have some problems. The shaft is a rotating piece while the guiding grooves provided on the seat for inserting the two ends of the shaft are static components. Therefore, the guiding grooves are exposed so that they are easily damaged and get dirt.

In view of the above drawbacks, the Inventor proposes the present invention based on his expert knowledge and elaborate researches in order to solve the problems of prior art.

SUMMARY OF THE INVENTION

Accordingly, an object of the present invention is to provide a crimping tool in which the guiding grooves are disposed on the slide module and the fix shaft is fixed across the two first side walls of the base and inserted in the guiding grooves, thus the guiding grooves are covered by the first side walls without being exposed; thus, the guiding grooves will not be damaged and get dirt.

In order to achieve the object mentioned above, the present invention provides a crimping tool including a base having two opposite first side walls disposed at interval and a sliding space being defined therebetween; a press handle having one end pivoted at an end of the base; a slide module being slidably accommodated in the sliding space and having at least one guiding groove; a link having a first end and a second end; the first end being pivoted between two ends of the press handle, and the second end being pivoted at the slide module; and a fixed fix shaft disposed across the two first side walls of the base and inserted in the at least one guiding groove; wherein the press handle drives the slide module sliding in the sliding space through the link, and the slide module is guided by the fix shaft through the at least one guiding groove.

Compared to the prior art, the present invention has the following effects. The guiding grooves are covered by the first side walls without being exposed, thus the guiding grooves will not be damaged and get dirt.

BRIEF DESCRIPTION OF DRAWING

The features of the invention believed to be novel are set forth with particularity in the appended claims. The invention itself, however, may be best understood by reference to the following detailed description of the invention, which describes a number of exemplary embodiments of the invention, taken in conjunction with the accompanying drawings, in which:

DETAILED DESCRIPTION OF THE PREFERRED EMBODIMENTS

In cooperation with attached drawings, the technical contents and detailed description of the invention are described thereinafter according to a number of preferable embodiments, being not used to limit its executing scope. Any equivalent variation and modification made according to appended claims is all covered by the claims claimed by the present invention.

Figure 1:
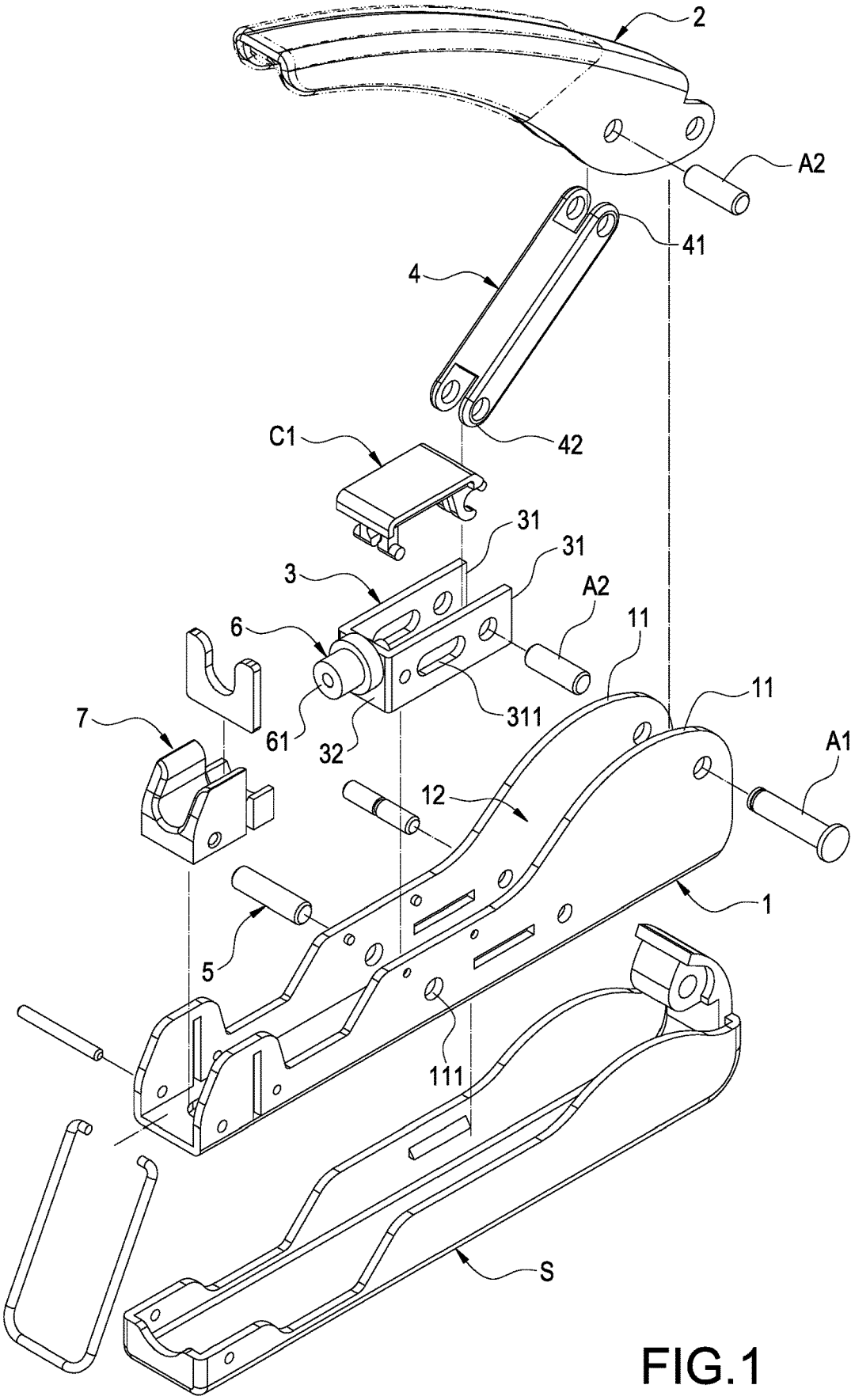
FIG. 1 is a perspective explosion view of a first embodiment of the present invention.
Figure 2:
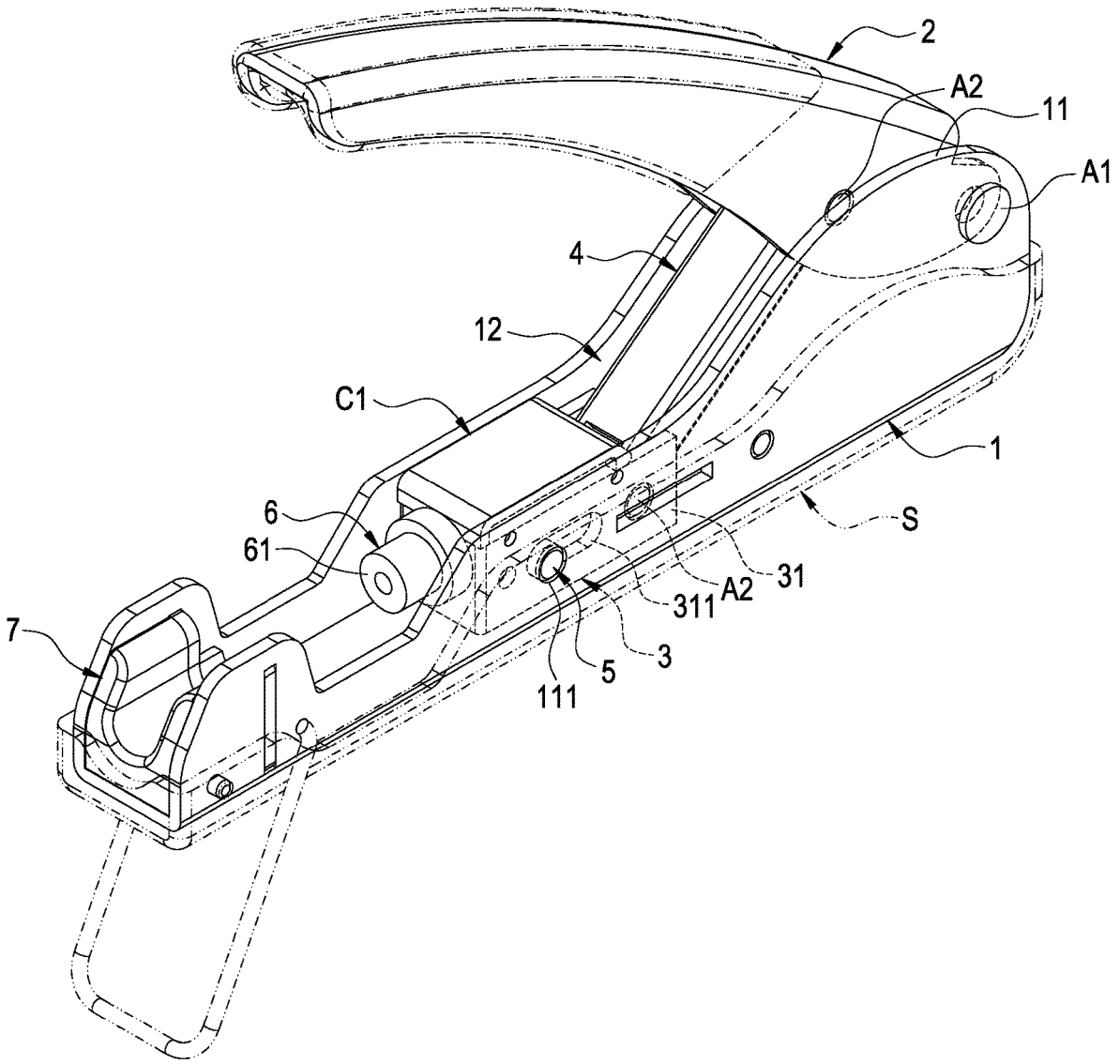
FIG. 2 is a perspective assembly view before crimping of a first embodiment of the present invention.
Figure 3:
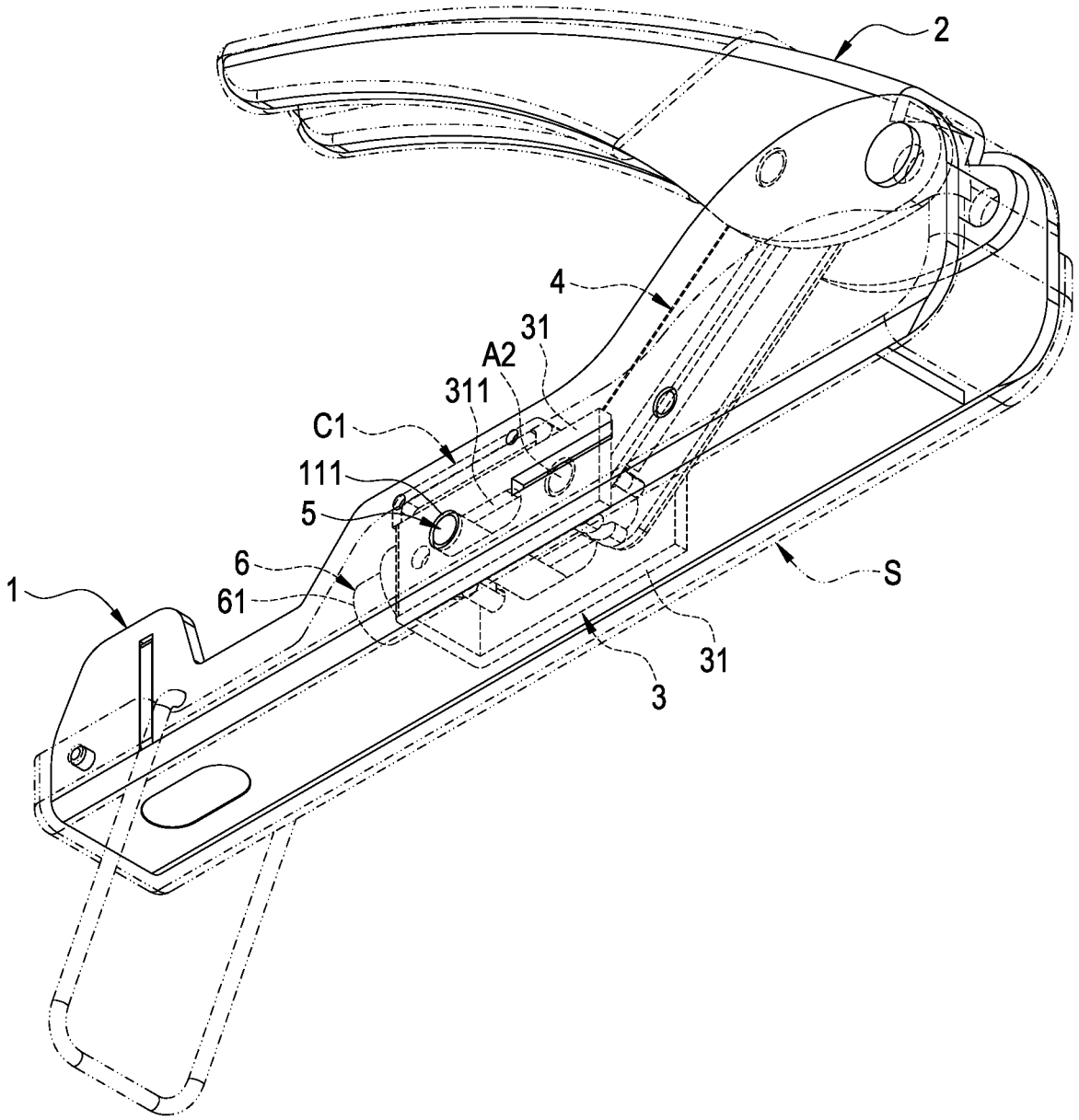
FIG. 3 is another perspective assembly view before crimping of a first embodiment of the present invention.
Figure 4:
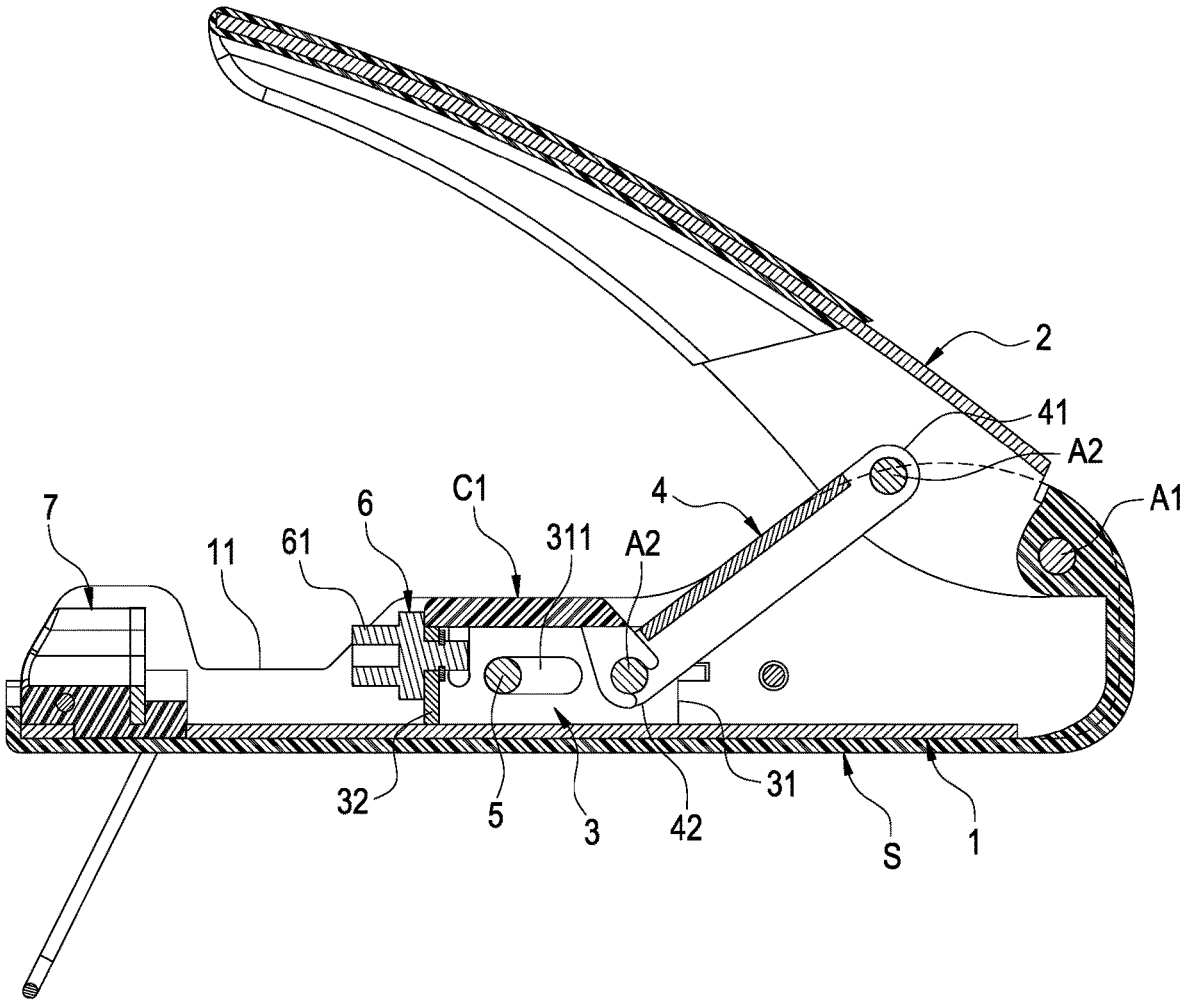
FIG. 4 is a cross sectional view before crimping of a first embodiment of the present invention.
Figure 5:
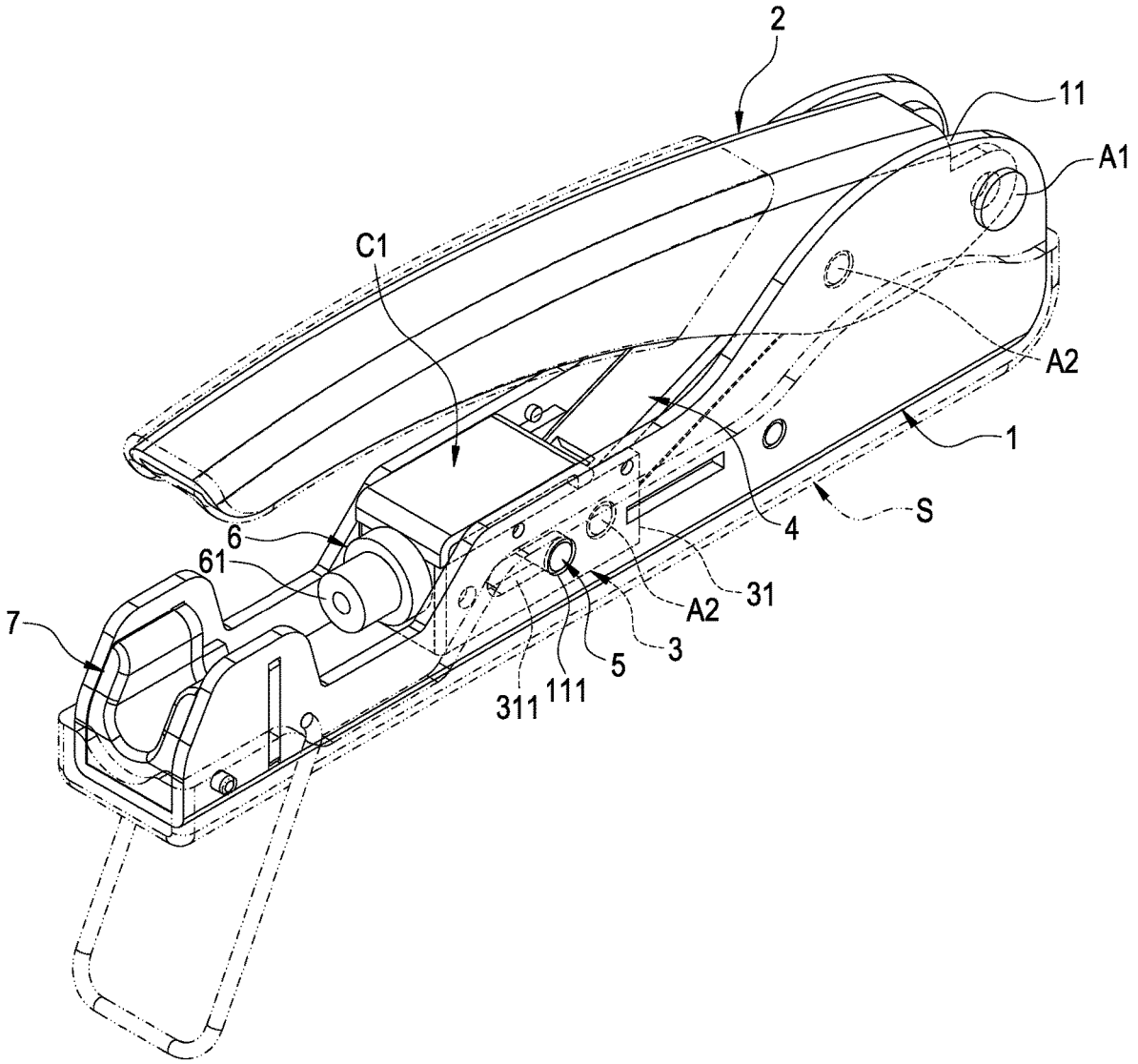
FIG. 5 is a perspective assembly view after crimping of a first embodiment of the present invention.
Figure 6:
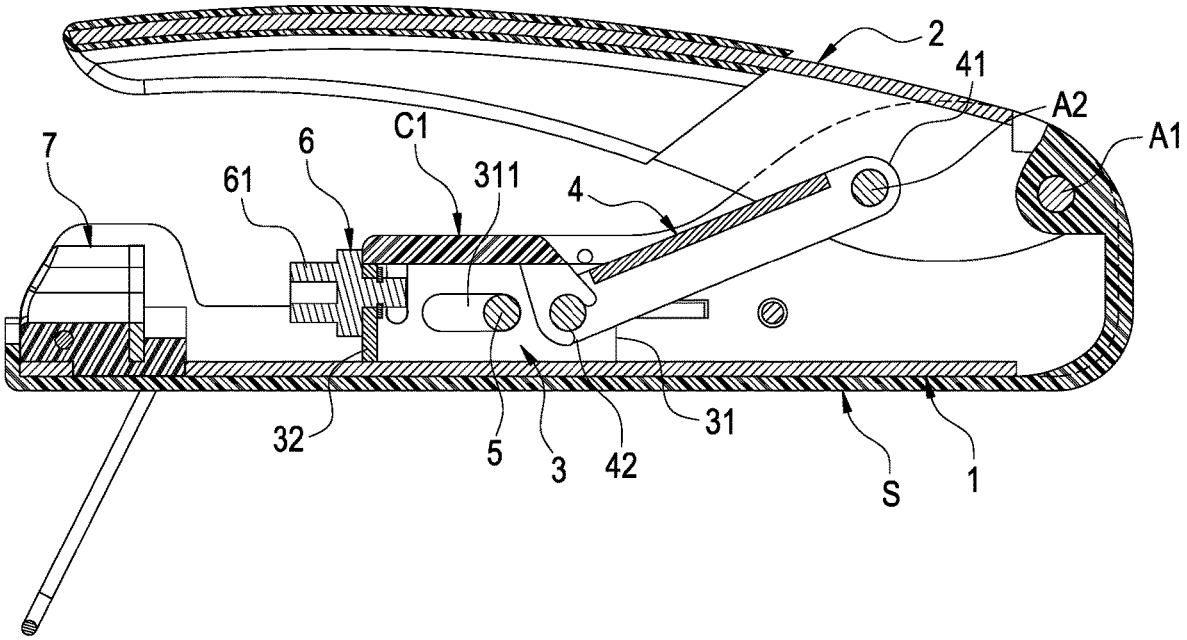
FIG. 6 is a cross sectional view after crimping of a first embodiment of the present invention.
Figure 7:
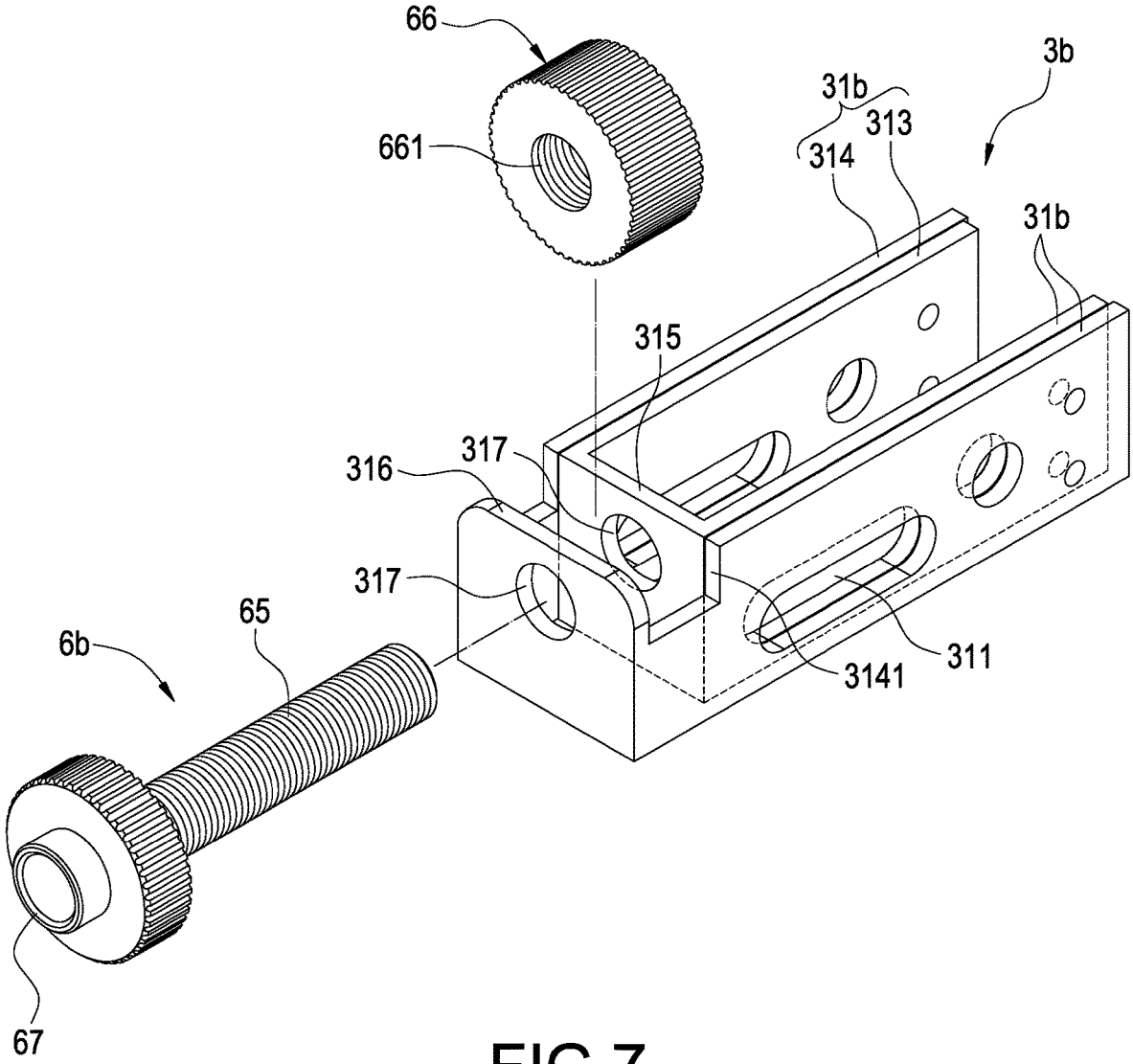
FIG. 7 is a perspective explosion view of a slide module and a driven component of a second embodiment of the present invention.
Figure 8:
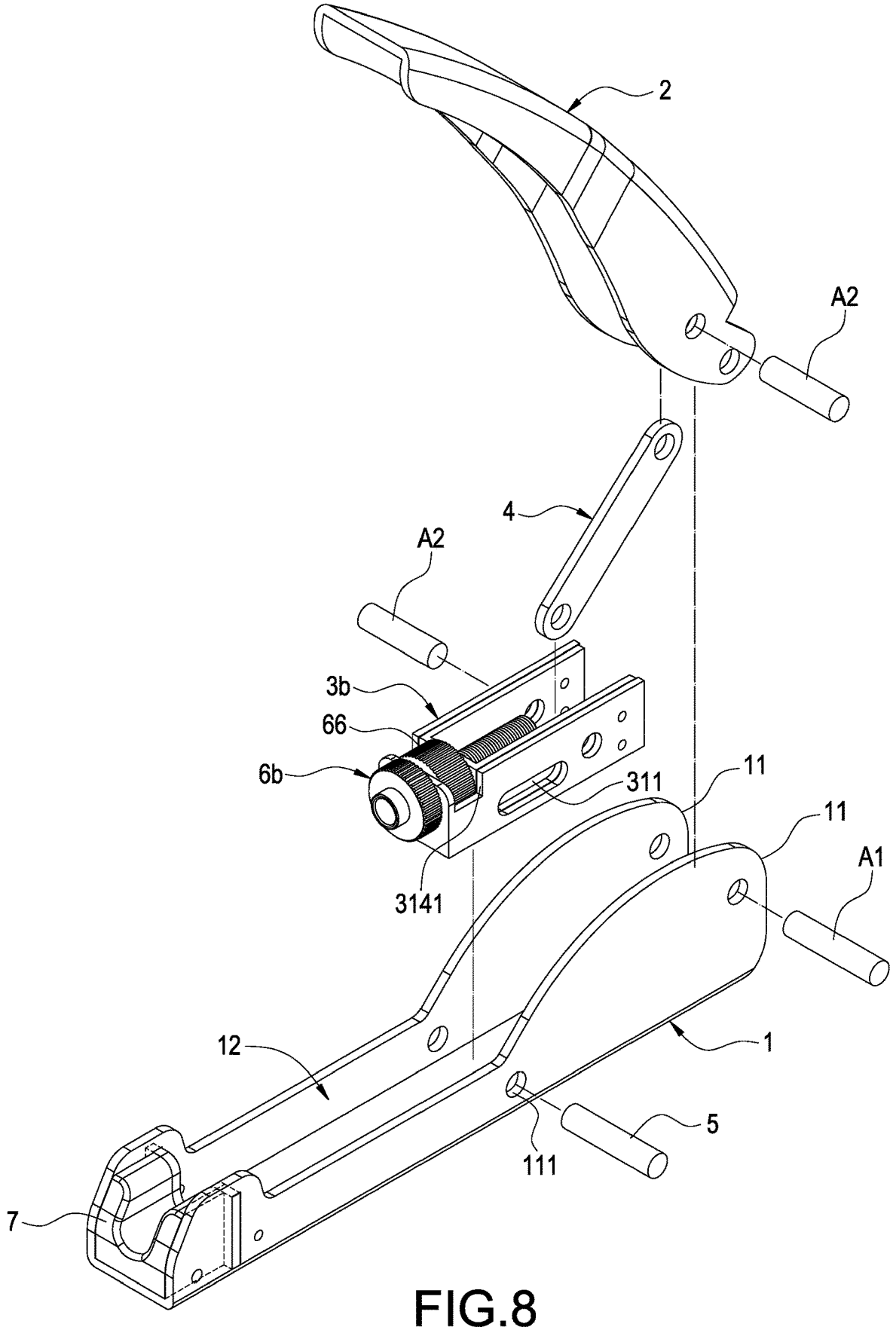
FIG. 8 is a perspective explosion view of a second embodiment of the present invention.

The present invention provides a crimping tool, as shown in FIG. 1 or FIG. 7, operations of crimping (or cutting) are performed through driving a slide module 3, 3*b* moving in the seat 1 by pressing a press handle 2 by users. A first embodiment of the present invention is shown in FIG. 1 to FIG. 6; and a second embodiment is shown in FIG. 7 to FIG. 13.

Please refer to FIG. 1 to FIG. 4, they depict a crimping tool of a first embodiment of the present invention including a base 1, a press handle 2, a slide module 3, a link 4 and a fixed fix shaft 5. More specifically, the crimping tool further includes a driven component 6.

The base 1 has two first side walls 11 disposed oppositely at interval, and a sliding space 12 is defined between the two first side walls 11 and a bottom plate (not numbered).

The press handle 2 has one end pivoted at ends of the two first side wall 11 of the base 1 through a first pivot A1 for the press handle 2 can be pressed and lifted corresponding to the base 1 by the pivot as a shaft.

The slide module 3 is slidably accommodated in the sliding space 12 and has at least one guiding groove 311. The slide module 3 can be provided with a guiding groove 311 only on one side wall or provided with a plurality of guiding grooves 311 on the plurality of side walls. In the present embodiment, a plurality of guiding grooves 311 are described in the embodiment. The slide module 3 includes two second side walls 31 spaced apart from each other and a connecting wall 32 connected between the two second side walls 31. In addition, the two second side walls 31 are provided with the guiding groove 311 separately. Preferably, the guiding groove 311 is located between two ends of the second side wall 31.

The link 4 has a first end 41 and a second end 42. The first end 41 is pivoted between two ends of the press handle 2 by a second pivot A2, and the second end 42 is pivoted at the slide module 3 (see FIG. 4) by another second pivot A2. The second end 42 of the link 4 is pivoted between ends of the two second side wall 31 through the second pivot A2 and forms as a pivot portion (not numbered), and the pivot portion is staggered with the two guiding grooves 311. Specifically, the second end 42 is pivoted at ends between the two second side walls 31 through the second pivot A2. The connecting wall 32 is connected between the other ends of the two second side walls 31. Besides, the link 4 has a width corresponding to a spacing between the two second side walls 31.

The fix shaft 5 is disposed across the two first side walls 11; therefore, the fix shaft 5 is fixed at the base 1 to be a fixed component. More specifically, two first side walls 11 are provided with a fix hole 111 separately, and two ends of the fix shaft 5 are inserted in the two fix holes 11 respectively so that two ends of the fix shaft 5 are inserted in the fix hole 111 separately for disposing across the two second side walls 11. Thus, the fix shaft 5 is inserted in the two guiding grooves 311 of the slide module 3.

Please refer to FIGS. 2, 4, 5 and 6, when users press the press handle 2, the press handle 2 drives the slide module 3 sliding in the sliding space 12 through the link 4 for performing crimping, and in the process of sliding, the two guiding grooves 311 of the slide module 3 are guided and restricted (a range of sliding of the slide module is limited) by the fix shaft 5.

In the first embodiment of the present invention, the driven component 6 is connected with the connecting wall 32 for crimping. Besides, a crimping member 7 is further included and disposed at another end of the two first side walls 11 (that is disposed at an end of the sliding space 12) so that the driven component 6 moves following with the slide module can be crimped with respect to the crimping member 7. In particular, the driven component 6 has a crimping member 61 protruding the connecting wall 32, and the crimping member 61 is used for crimping with the crimping member 7.

In addition, there is a cover C1 positioned on the walls of the slide module 3, and there is a shell S located on the walls of the base 1 for enhancing aesthetics.

As shown in FIG. 7 to FIG. 13, a crimping tool of a second embodiment of the present invention is substantially the same as the first embodiment described above. The differences are in that a slide module 3*b* and a driven component 6*b*. Besides, the shell S and the cover C1 of the first embodiment are omitted.

As shown in FIG. 7 to FIG. 11, a slide module 3*b* and a driven component 6*b* of the second embodiment of the present invention are described as follows.

The slide module 3 is slidably accommodated in the sliding space 12 and has two brackets 315, 316 spaced from each other so that a driven component 6*b* is disposed across the two brackets 315, 316. Preferably, the slide module 3*b* includes two second side walls 31*b* spaced apart from each other and two brackets 315, 316 both connected between the two second side walls 31*b*. The two second side walls 31*b* are provided with the guiding groove 311 separately, and the slide module 3*b* is guided by the fix shaft 5 through the two guiding grooves 311.

The structures of the second side wall 31*b* of the present invention are not limited, thus type of structures can be provided as a single structure or a combination structure. In this embodiment, a combination structure is provided as an example for explanation. The second side walls 31*b* includes an inner side wall 313 and an outer side wall 314 overlapping with each other. One side of the two outer side walls 314 protrudes a distance from one side of the two inner side walls 313 respectively. The two brackets 315, 316 are connected between ends of the two inner side walls 313 and between ends of the two outer side walls 314 respectively. The guiding groove 311 penetrates through the inner side wall 313 and the outer side wall 314.

The driven component 6*b* includes a screw 65, a crimping assembly 67 disposed at an end of the screw 65 and an adjust nut 66 screwed with the screw 65. The screw 65 is disposed across the two brackets 315, 316 through an insertion. The adjust nut 66 is restricted between the two brackets 315, 316 in a direction of the length of the screw 65. Specifically, the adjust nut 66 is positioned between the two brackets 315, 316 which are arranged spaced apart and side by side, thus the adjust nut 66 can only be rotated in place without moving along in a direction of the length of the screw 65. Moreover, the crimping assembly 67 and the crimping member 7 are opposite in a direction of the length direction of the screw 65.

Two ends of the fix shaft 5 are inserted in the fix holes 111 of the base 1 and disposed across the two first side walls 11 of the base 1 (refer to FIG. 8 and FIG. 11) to be a fixed component, wherein the fix shaft 5 is inserted both in the two guiding grooves 311 of the slide module 3*b*.

Figure 9:
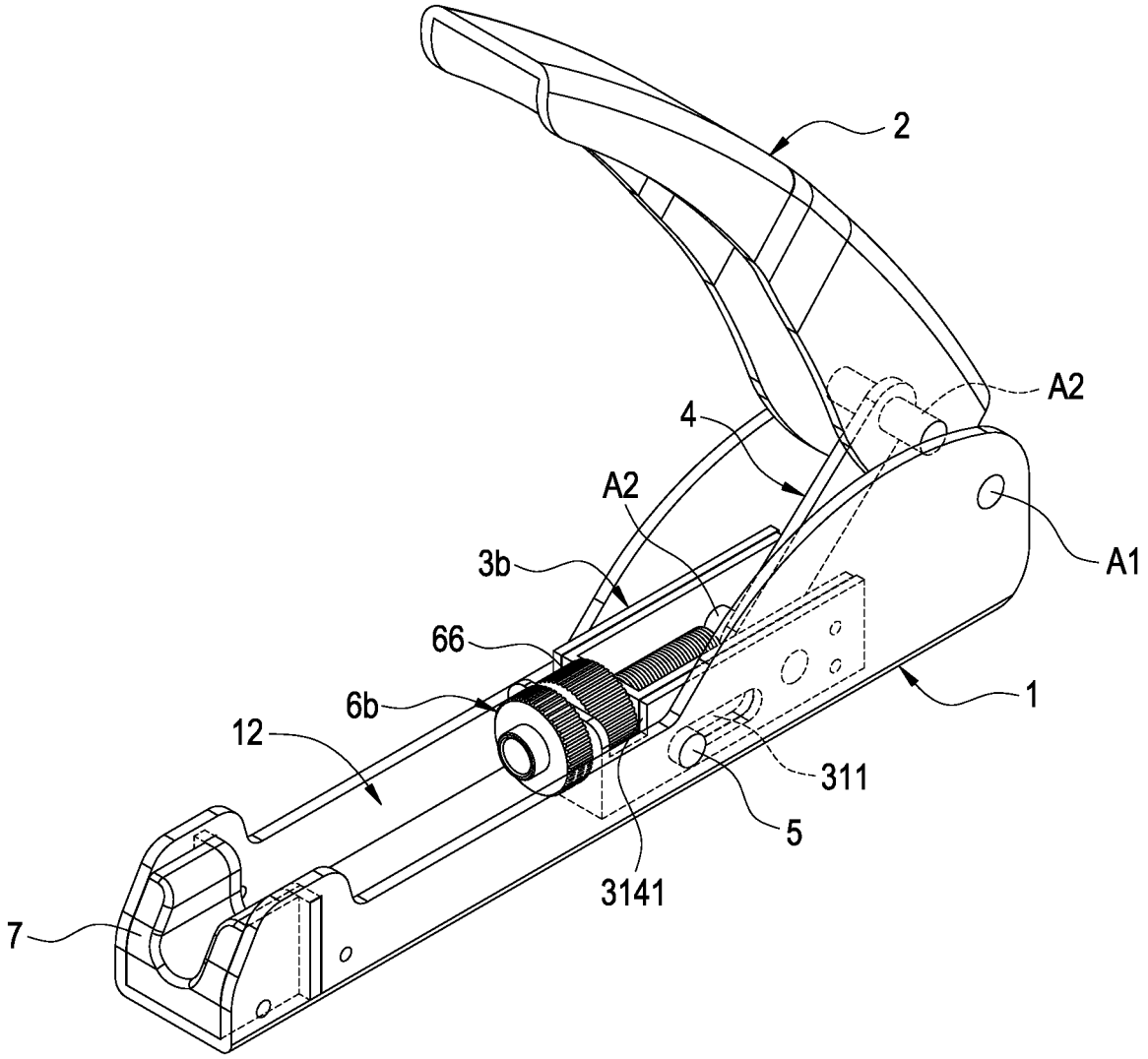
FIG. 9 is a perspective assembly view of a second embodiment of the present invention.
Figure 10:
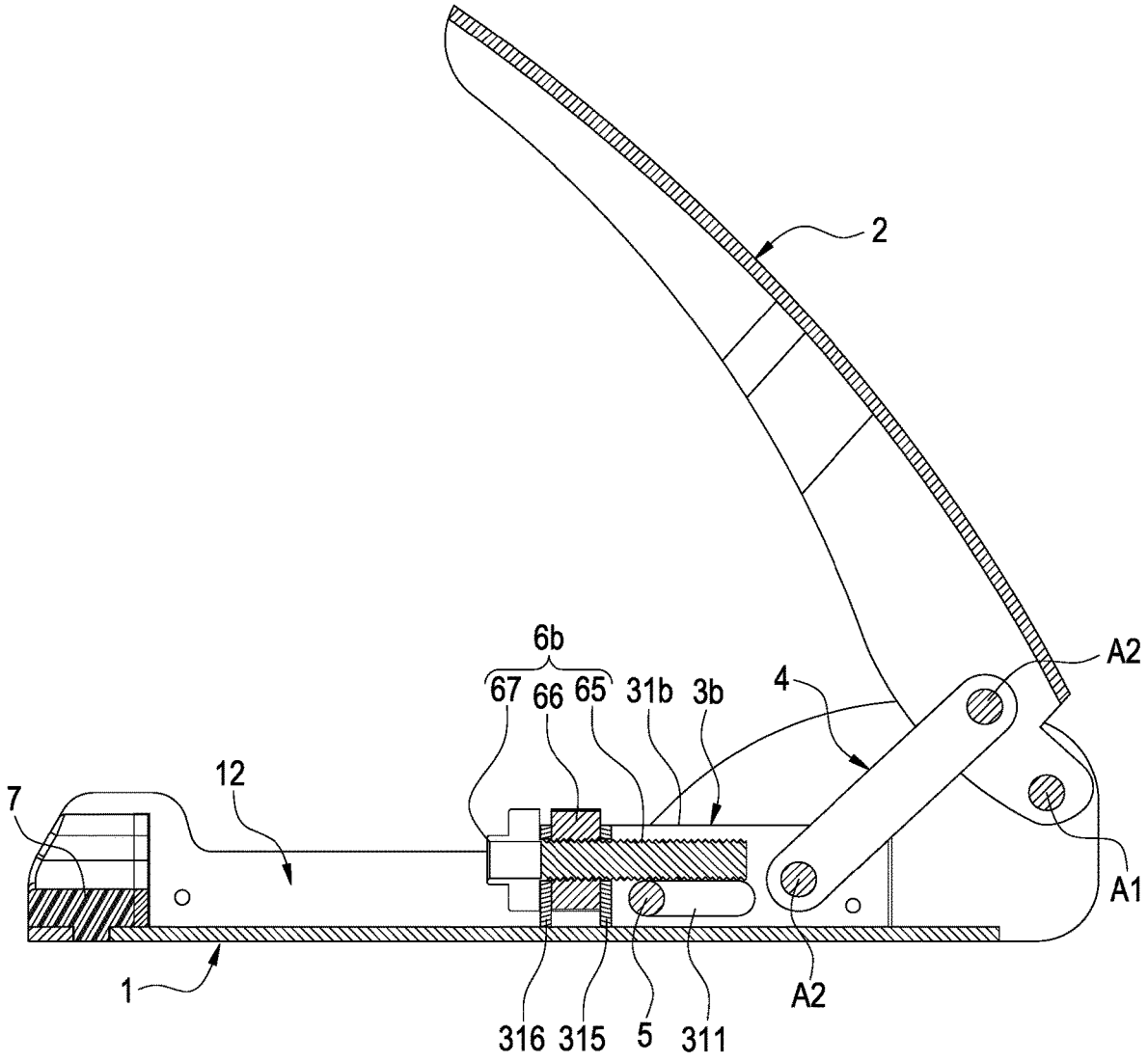
FIG. 10 is a cross sectional view before crimping and adjusting of a second embodiment of the present invention.
Figure 11:
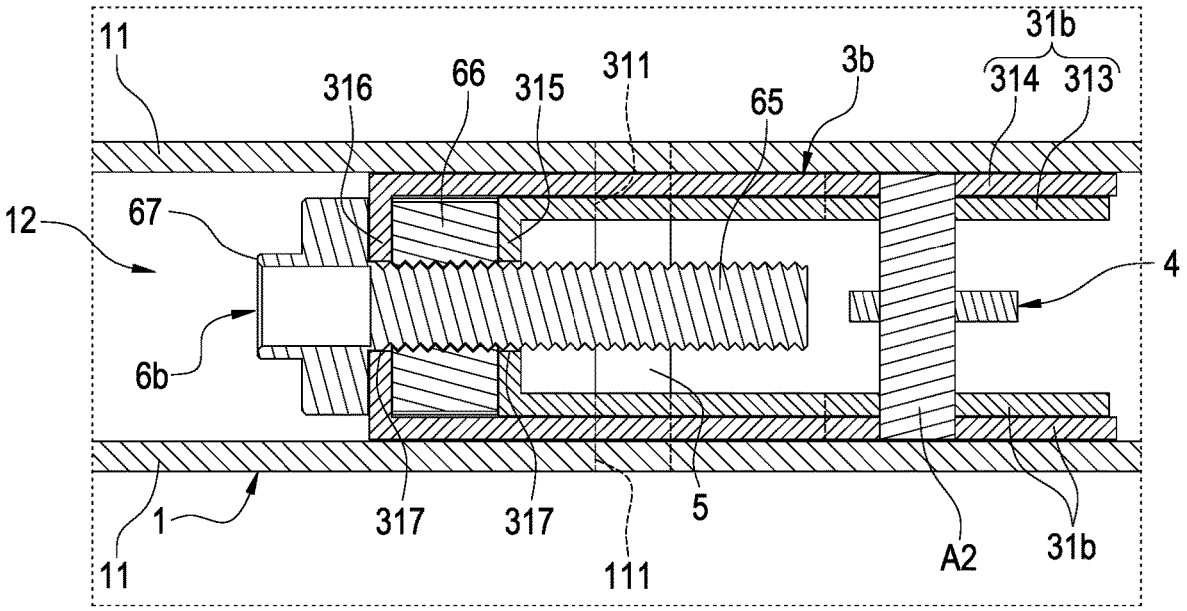
FIG. 11 is a partial top view of FIG. 10 of a second embodiment of the present invention.
Figure 12:
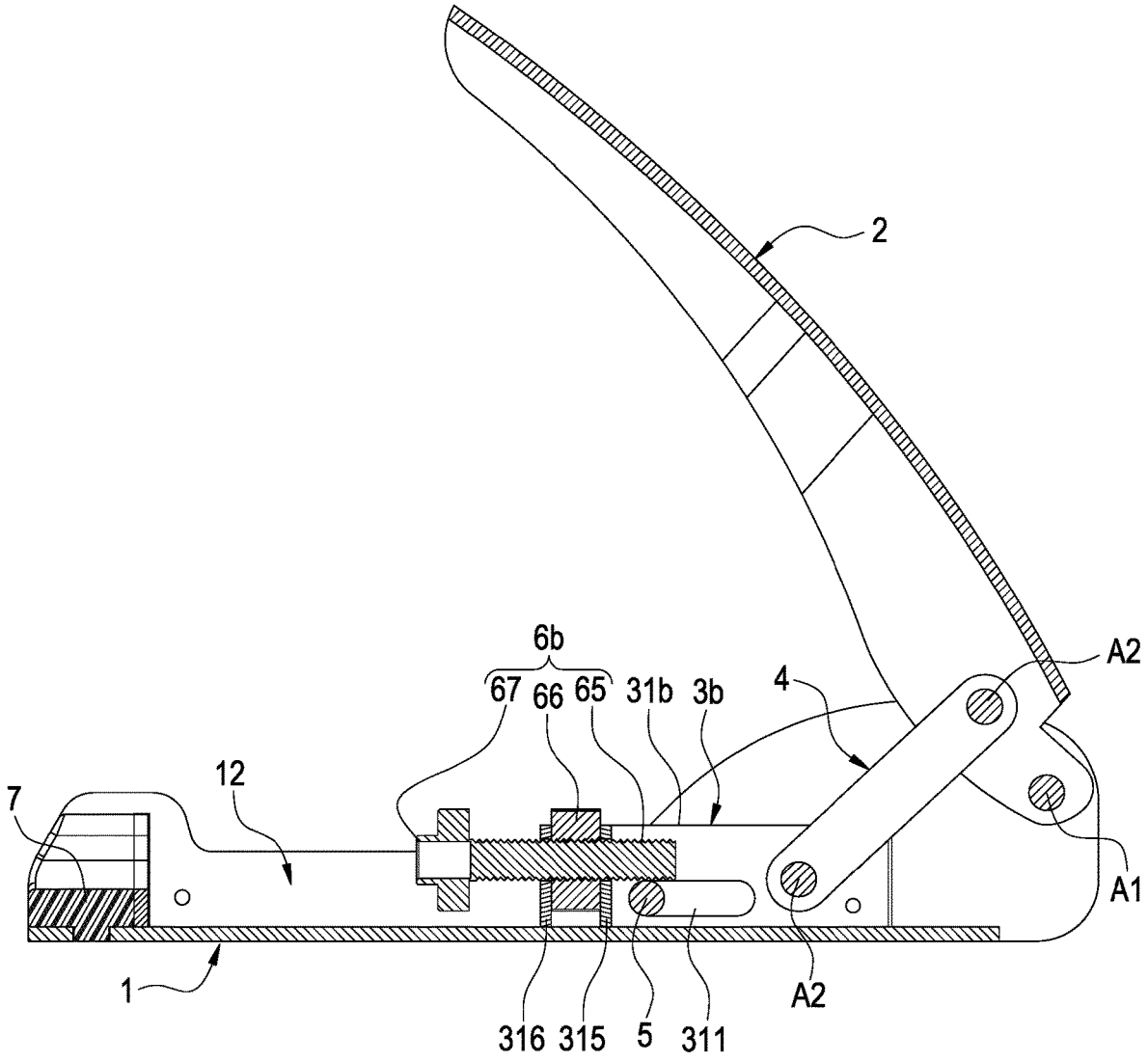
FIG. 12 is a cross sectional view after adjusting of a second embodiment of the present invention.
Figure 13:
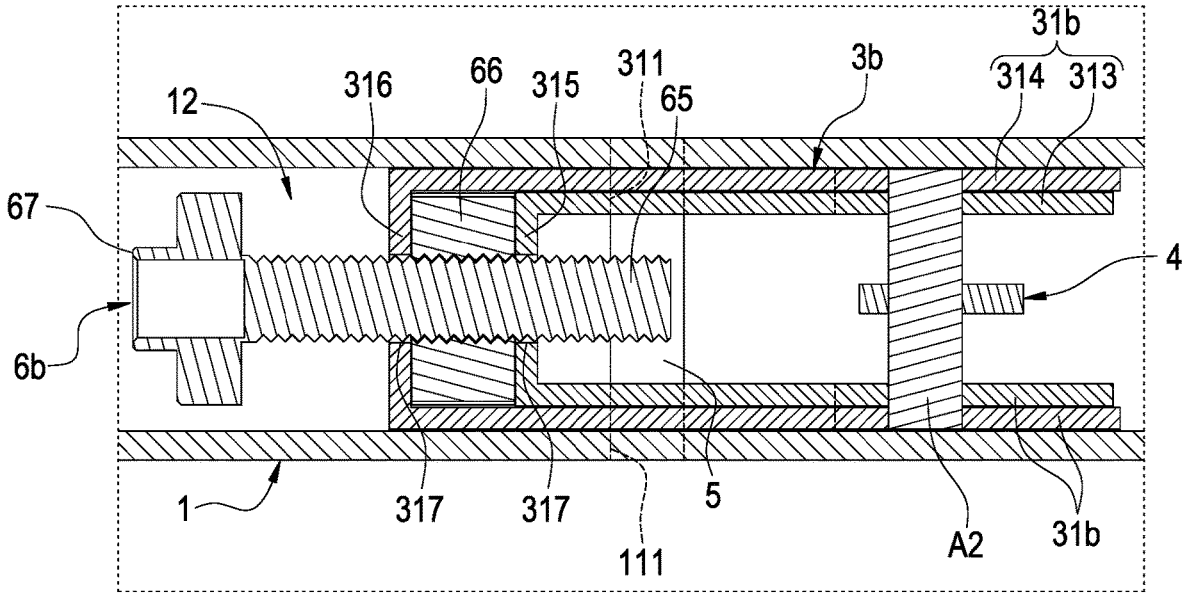
FIG. 13 is a partial enlarged view of FIG. 12 of a second embodiment of the present invention.

Please also refer to FIG. 9 and FIG. 10. Therefore, when users press the handle 2, the press handle 2 drives the slide module 3*b* sliding in the sliding space 12 through the link 4 for crimping. Besides, in the process of sliding, the two guiding grooves 311 of the slide module 3*b* are guided and restricted by the fix shaft 5 (to limit the range of the sliding of the slide module 3*b*).

As shown in FIG. 10, 11 and FIG. 12, 13, when the distance between the crimping assembly 67 and the crimping member 7 needs to be adjusted, users just simply rotate the adjust nut 66 then the screw 65 can be retractable with respect to the two brackets 315, 316 so as to achieve the purpose of adjusting the distance between the crimping assembly 67 and the crimping member 7 manually.

Furthermore, as shown in FIG. 7, the adjust nut 66 has provided with a screw hole 661 for screwing with the screw 65. Please refer to FIG. 7 and FIG. 11, the two brackets 315, 316 are provided with a through hole 317 separately, and the screw 65 is inserted in the two through holes 317. With referring to FIG. 7 and FIG. 9, at least one of the two outer side walls 314 is provided with a notch 3141 corresponding to the adjust nut 66. In the present embodiment, the two outer side walls 314 are both provided with a notch 3141 so that the adjust nut 66 will be protruded out of the slide module 3*b* for facilitating manual adjustments. Preferably, a partial periphery of the adjust nut 66 is protruded out of the slide module 3*b* for facilitating the manual adjustments.

In summary, the first and second embodiments of the present invention which are compared with the prior art have the following effects. Firstly, because the guiding grooves 311 are disposed at the slide module 3, 3*b* and the fix shaft 5 is disposed across the two first side walls 11 and inserted in the guiding grooves 311, the guiding grooves 311 are covered by the first side walls 11 without being exposed. Thus, the guiding groove 311 will not be damaged and get dirt for being not exposed. Secondly, since the portions where the link 4 pivoted at two second side walls 31, 31*b* of the slide module 3, 3*b* are staggered with the two guiding grooves 311 disposed at the two second side walls 31, 31*b*, that is, the portions driven by the link 4 and the portions guided by the fix shaft 5 are staggered from each other (located at different places), the driving force of the link 4 and the guiding force of the fix shaft 5 are not concentrated at one place of the slide module 3, 3*b* but dispersed at two places. Therefore, the structures will not damage easily.

The first embodiment of the present invention has following effects. The link 4 has a width corresponding to the distance between the two second side walls 31; thus, the force will be provided in a line contact manner when the link 4 with the width is pushed and pulled with respect to the second pivot A2; thereby, a traditional pushing and pulling of a point contact manner will be improved so as to avoid of damage (due to stress concentration).

The second embodiment of the present invention has following effects. The screw 65 of the driven component 6*b* is movably inserted between the two brackets 315, 316, and the adjust nut 66 is restricted between the two brackets 315, 316 so that it can be adapted to a variety of different sizes by adjusting the distance between the crimping assembly 67 and the crimping member 7. Besides, the screw 65 can be supported stably to prevent the screw 65 from tilting, and a smooth adjustment is ensured.

Although the present invention has been described with reference to the preferred embodiment thereof, it will be understood that the invention is not limited to the details thereof. Various substitutions and improvements have been suggested in the foregoing description, and others will occur to those of ordinary skill in the art. Therefore, all such substitutions and improvements are intended to be embraced within the scope of the invention as defined in the appended claims.

What is claimed is:

1. A crimping tool, including:

a base having two opposite first side walls disposed at an interval and a sliding space defined therebetween;

a press handle, wherein one of two ends of the press handle is pivoted at an end of the base;

a slide module slidably accommodated in the sliding space and having at least one guiding groove;

a link having a first end and a second end; the first end pivoted between the two ends of the press handle and the second end pivoted at the slide module;

a driven component, wherein the driven component includes a screw, a crimping assembly disposed at an end of the screw and an adjust nut screwed with the screw; the slide module has two brackets spaced from each other; the screw is inserted in the two brackets, and the adjust nut is restricted between the two brackets in a direction of a length of the screw; the screw is selectively retractable with respect to the two brackets for adjusting a position of the crimp assembly; and a fixed fix shaft disposed across the two first side walls and inserted in the at least one guiding groove;

wherein the slide module includes two second side walls spaced apart from each other, and the two brackets are both connected between the two second side walls; the two brackets are arranged spaced apart; the adjust nut is positioned between the two brackets; the at least one guiding groove includes two guiding grooves respectively disposed on the two second side walls, and the fix shaft is inserted in the two guiding grooves; the slide module is guided by the fix shaft through the two guiding grooves, wherein each of the two second side walls includes an inner side wall and an outer side wall overlapping with each other; one side of the two outer side walls protrudes a distance from one side of the two inner side walls; the two brackets are respectively connected between the two inner side walls and between the two outer side walls; the two guiding grooves penetrate through the two inner side walls and the two outer side walls, wherein the press handle drives the slide module sliding in the sliding space through the link, and the slide module is guided by the fix shaft through the at least one guiding groove, and wherein the at least one guiding groove is covered by the two first side walls.

2. The crimping tool according to claim 1, wherein the slide module includes two second side walls spaced apart from each other and a connecting wall connected between the two second side walls; the at least one guiding groove includes two guiding grooves respectively disposed on the two second side walls, and the fix shaft is inserted in the two guiding grooves; the slide module is guided by the fix shaft through the two guiding grooves.

3. The crimping tool according to claim 2, further including a driven component, wherein the driven component is connected with the connecting wall for crimping.

4. The crimping tool according to claim 2, wherein the link has a width corresponding to a spacing between the two second side walls.

5. The crimping tool according to claim 2, wherein the second end of the link is pivoted at two ends of the two second side walls respectively.

6. The crimping tool according to claim 2, wherein the second end of the link is pivoted at two ends of the two second side walls respectively through a second pivot that forms as a pivot portion; the pivot portion is staggered with the two guiding grooves.

7. The crimping tool according to claim 1, further including a driven component, wherein the driven component is connected with the slide module for crimping.

8. The crimping tool according to claim 1, wherein each of the two brackets has a through hole, and the screw is inserted in the two through holes.

9. The crimping tool according to claim 1, wherein each of the two outer side walls has a notch corresponding to the adjust nut.

10. The crimping tool according to claim 1, wherein a periphery of the adjust nut is protruded from the slide module so as to facilitate adjustment.

11. The crimping tool according to claim 1, wherein one end of the base is provided with a crimping member; the crimp assembly and the crimping member are opposed to each other in a direction of a length of the screw.

12. The crimping tool according to claim 1, wherein the second end of the link is pivoted at two ends of the two second side walls respectively through a second pivot that forms as a pivot portion; the pivot portion is staggered with the two guiding grooves.

13. The crimping tool according to claim 1, wherein the second end of the link is pivoted at two ends of the two second side walls respectively.

* * * * *